US006000261A

United States Patent [19]

Johnston

[11] Patent Number: 6,000,261

[45] Date of Patent: Dec. 14, 1999

[54] METHOD AND APPARATUS FOR PORTABLE SPIRAL PIPE MANUFACTURING

[76] Inventor: Scott E. Johnston, 16857 Hummingbird La., Cottonwood, Calif. 96022

[21] Appl. No.: 09/212,048

[22] Filed: Dec. 15, 1998

Related U.S. Application Data

[60] Provisional application No. 60/069,620, Dec. 15, 1997.

[51] Int. Cl.[6] ..... B21C 37/12

[52] U.S. Cl. ..... 72/49

[58] Field of Search ..... 72/49, 50, 135, 72/137, 138, 142

[56] References Cited

U.S. PATENT DOCUMENTS

| | | |
|---|---|---|
| 3,247,692 | 4/1966 | Davis . |
| 3,269,162 | 8/1966 | Fay . |
| 3,606,783 | 9/1971 | Lewis . |
| 4,070,886 | 1/1978 | Nyssen . |

OTHER PUBLICATIONS

Nokia Hevac Division, Trailer for Nokia HLS 4/60–E Mobile Travelling Spiral Duct Line (Catalog) 1980's Published in Finland—Shows Smaller Duct Machine in Custom Trailer.

IMW Industries LTD., Culvert & Metal Forming Systems (Catalog) 1980's Published in Canada p. 2 Shows Standard Pipe Machine, p. 3 Shows Standard Pipe Machine on Custom Trailers.

*Primary Examiner*—Rodney Butler

[57] ABSTRACT

A machine for spirally forming pipes that is readily transportable to various locations. The machine is mounted to the surface of a conventional tractor-trailer arrangement and includes an uncoiler assembly with a structural extension arrangement for transferring coils from delivery vehicles. The uncoiler assembly is pivotably mounted to allow for rotational travel to meet with coil delivery vehicles. Sheet material is uncoiled and fed to the spiral forming assembly by an assembly of cylindrical rollers with rotational energy provided by internal combustion engine. The spiral forming assembly is pivotably mounted with motorized connection and programmable control for helix angle and third set of rollers adjustment. The spiral forming assembly and the assembly of cylindrical rollers are mounted with bases of minimal height for stability. An internal combustion engine driven cut off assembly is mounted directly to the spiral forming assembly to cut off pipes as they are produced. The machine has multiple pipe support stands that may be stored on the tractor-trailer arrangement with the pipe machine, and quickly set up at various locations.

17 Claims, 7 Drawing Sheets

METHOD AND APPARATUS FOR PORTABLE SPIRAL PIPE MANUFACTURING

CROSS-REFERENCE TO RELATED APPLICATIONS

This application claims the benefit of provisional patent application No. 60/069,620 Filed Dec. 15, 1997.

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

This invention relates to a spiral pipe machine that can produce pipes at various locations.

Spiral pipe machines have been widely used for producing corrugated lockseam pipes and smooth welded seam pipes. These machines are most commonly found at factories throughout the country in locations within a two hundred mile radius of where the pipes produced will be used. These machines produce pipes from raw material of steel sheet in coil form. Common thickness of raw material ranges from 1 mm to 25 mm and common widths range from 0.5 meter to 1.5 meter with a typical coil weight of 10 tons. Pipes are produced on these machines in a range of sizes from 0.3 meter to 3.6 meter diameter and in lengths up to 12 meter. Spiral pipe machines all have in common equipment for uncoiling coils into sheet form, then feeding the sheet into a spiral pipe forming assembly and then onto a pipe support. Spiral pipe forming assemblies use lockseaming, welding or both to join material edges. Prior attempts were made to allow for spiral pipe machines to be transported to various locations for producing pipes. These machines had various disadvantages. One major difficulty is that these pipe machines required an electrical power source at the location they were traveling to, thus requiring a large generator or electrical hookup at location. Also ability to remove coils of raw materials from delivery vehicles and install the coil onto the uncoiler was not considered, thus requiring a special fork lift or some other type of equipment to perform this function at location. Another problem could be found in the fact that by using basically the same machines as they would use in factory installation, these machines required very specialized trailers to allow for manufacturing set up and in the case of larger machines special outriggers were required for stability, this also meant that these machines were not readily transportable. Because these machines were of standard factory machine height, the operator of the machine would need to stand on top of the customized trailer arrangement in order to operate the controls. Which was a safety concern. Since these machines were basically the same as the factory installed models, they were built with the same diameter and length capacities. One result being that only short lengths of pipe could be produced, longer lengths still required couplings.

BRIEF SUMMARY OF THE INVENTION

The invention comprises a machine for spirally forming pipes that is readily transportable to various locations. The machine includes an uncoiler assembly for uncoiling the steel sheet from raw material in coil form, an assembly of cylindrical rollers for sheet feeding driven by an internal combustion engine, a spiral pipe forming assembly and means for pipe support. This machine is designed for mounting on a conventional trucking industry trailer. The sheet feeding and spiral pipe forming portions of the machine are designed of reduced height for safety and stability. The pipe support is designed to enable efficient set up at various locations. The uncoiler assembly is designed to allow for the transfer of coils from delivery vehicles.

It is the principal object of the present invention to provide a machine for the spirally forming of pipes that is readily transportable and not limited by the diameter and length considerations of the factory style machines.

This and other advantages of the present invention will become apparent from following the detailed description taken in conjunction with the accompanying drawings.

DETAILED DESCRIPTION OF THE INVENTION

Figure 1:
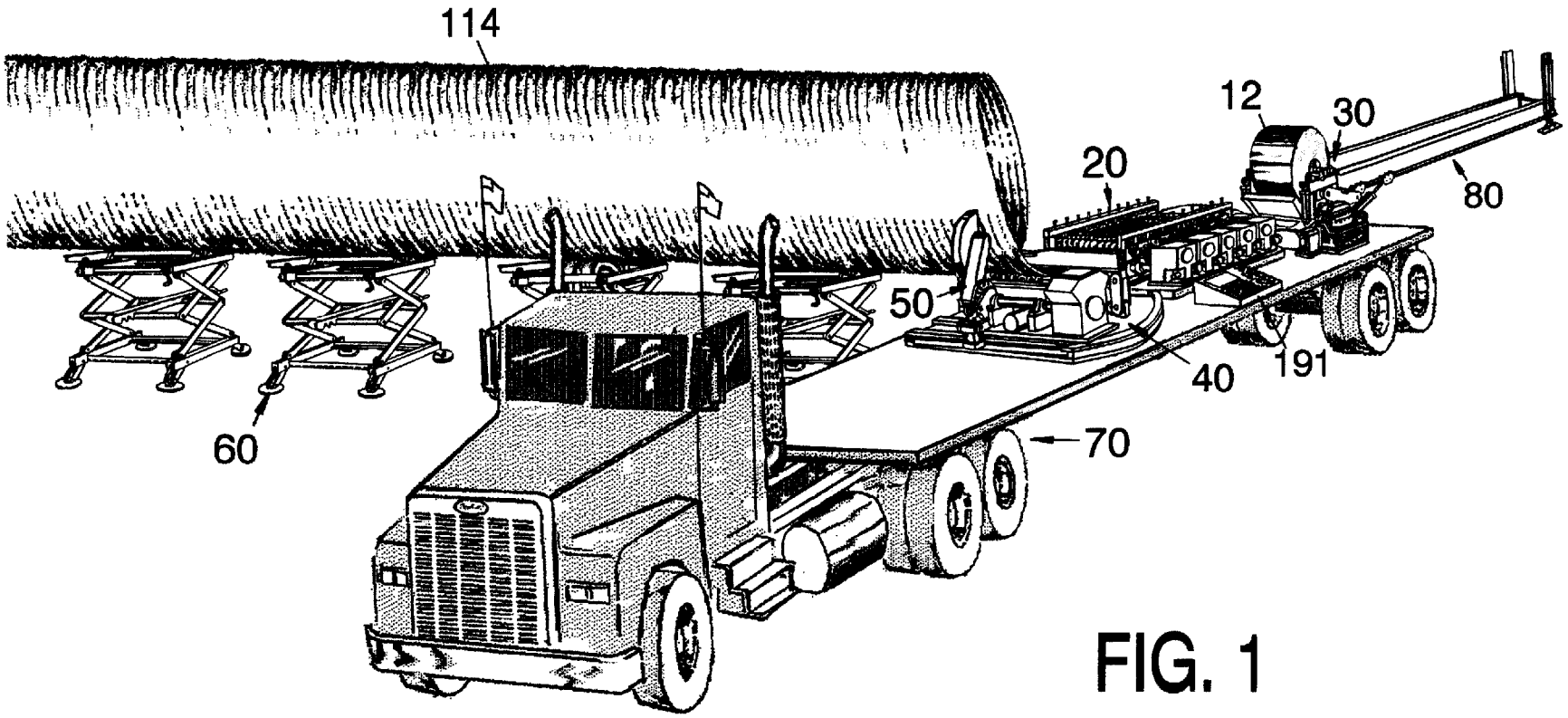
FIG. 1 is a perspective view of the portable spiral pipe forming machine mounted to the surface of a conventional flat bed tractor-trailer rig such as is common to the trucking industry with a coil of raw material as its formed into a spiral pipe being positioned thereon.

Referring now in detail to the drawings, the present invention, a vehicle transportable apparatus for spirally forming pipes is most clearly shown in FIG. 1, comprising an uncoiler assembly 30, to support the coil 12, an assembly of cylindrical rollers 20 to feed the sheet of uncoiled material into the spiral forming assembly 40 for forming the pipe 114 onto the support stands 60.

Figure 2:
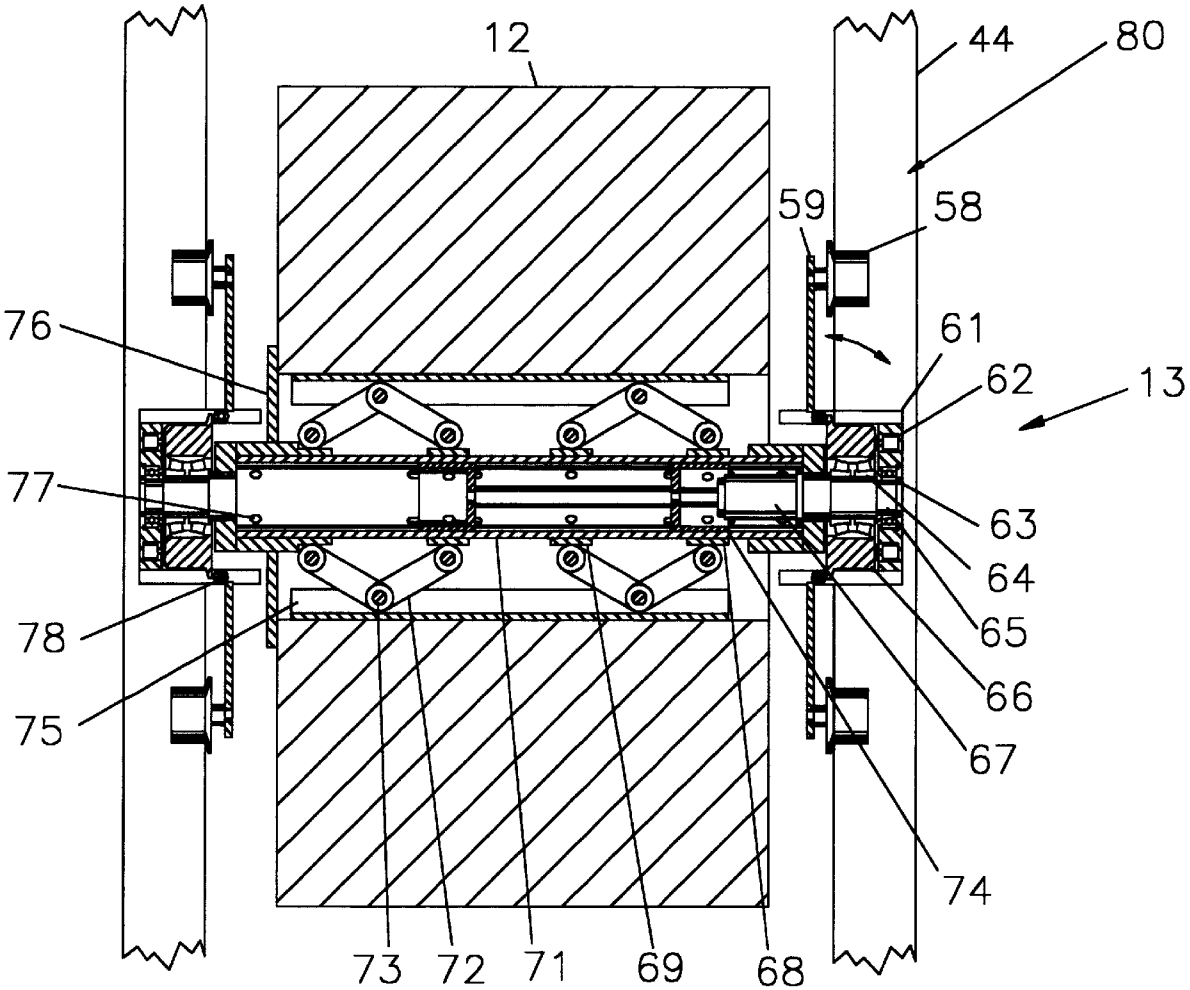
FIG. 2 is a cross sectional plan view of the means of traveling support of coils.
Figure 3:
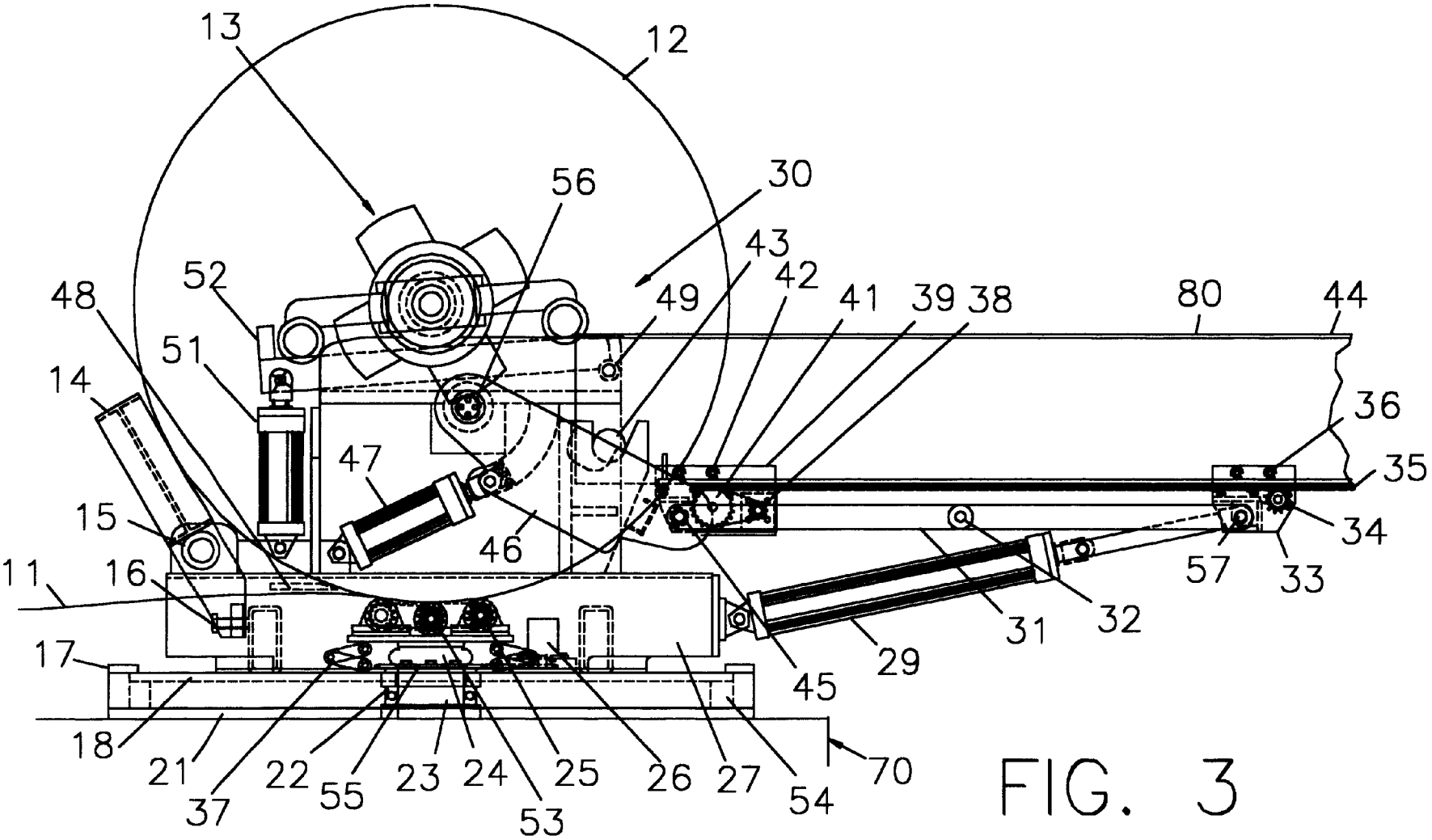
FIG. 3 is a side view of the uncoiler assembly and structural extension arrangement.
Figure 4:
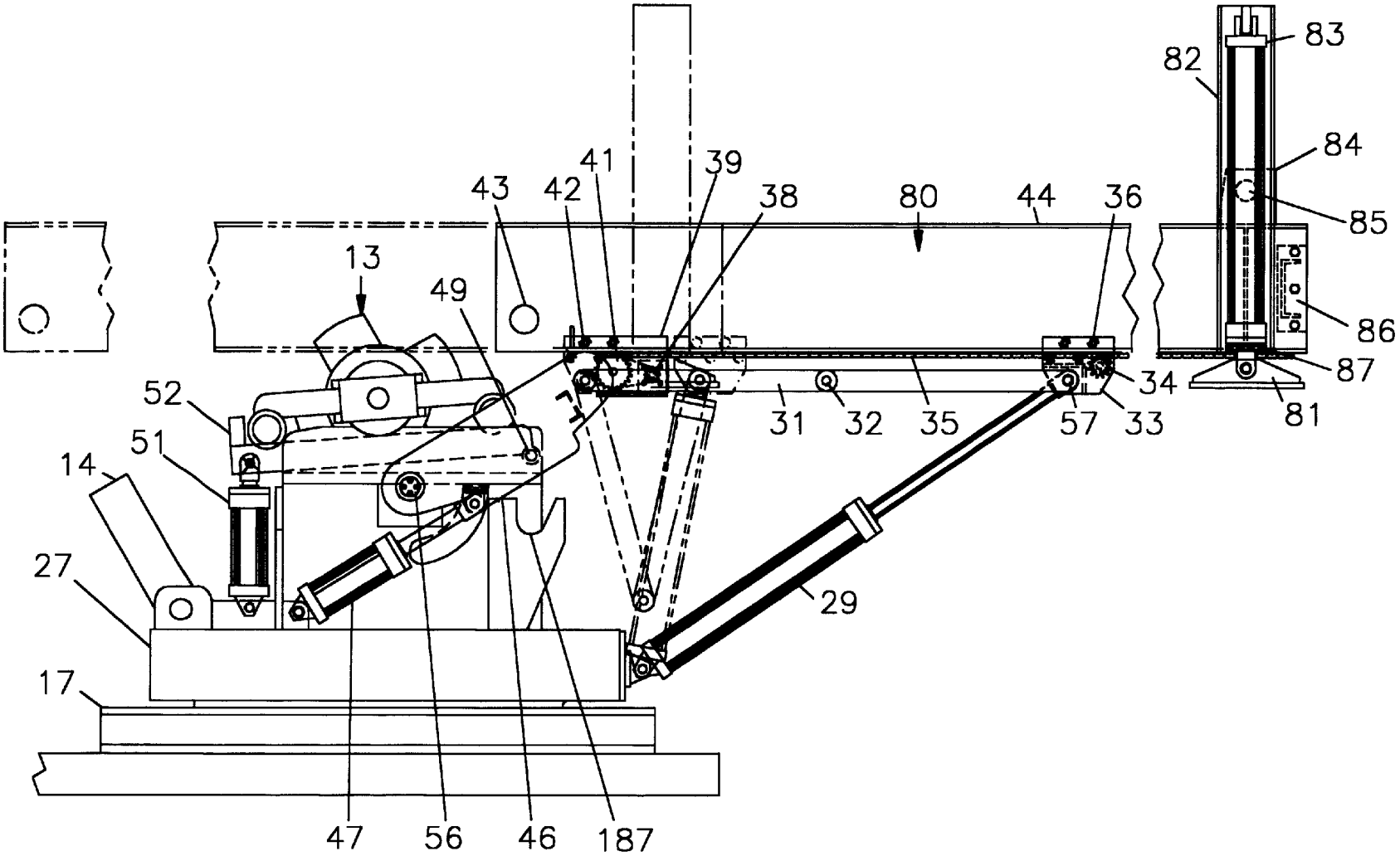
FIG. 4 is a side view of the uncoiler assembly with the structural extension arrangement in position for retracting.

Uncoiler assembly 30 with assembly of cylindrical rollers 20 and spiral forming assembly 40 are mounted to the surface of the tractor trailer arrangement 70 which provides ample room for storage of support stands 60 whereby the apparatus with all it comprises is transportable. The uncoiler assembly 30 includes a structural extension arrangement 80 and traveling coil support 13 as seen in FIGS. 2, 3 and 4. The traveling support 13 as most clearly shown in FIG. 2, comprises a pair of wheels 66 mounted with anti friction bearings 64 to extension shafts 65. Extension shafts 65 are a weldment tube and endcap that slip onto the tubular spindle 71. Both extension shafts 65 are secured to the tubular spindle 71 with multiple screws 77 spaced equally about their circumference. One extension shaft 65 has a coil stop ring 76 welded to it. The pair of wheels 66 provide for radial travel of the traveling coil support 13 upon the structural extension arrangement 80. A plurality of extension arms 59 and rollers 58 extend in either direction out from the center of the traveling coil support 13, to provide for rolling alignment. Rollers 58 are mounted with anti-friction bearings and threaded studs (not shown) to the extension arms 59. Extension arms 59 are pivotably mounted to the extension arm frame 61. Extension arms 59 swing in to allow for insertion of traveling support 13 into coil 12. Extension arm frame 61 is mounted to an anti-friction bearing 63 which is mounted to the extension shaft 65. A plurality of inner slide rings 74 fit inside tubular spindle 71 and are attached to a matching plurality of outer slide rings 68. They are secured with multiple shoulder screws placed equally about their circumference to allow for slideable movement with relationship to elongated slots provided in tubular spindle 71. A hand operated type hydraulic cylinder 67 with extension, is mounted to the inside end of one extension shaft 65, inside tubular spindle 71 and extended to connect with and act upon the inner slide rings 74. Tubular spindle 71 is fitted with a fixed ring 69, with pivot lugs welded to it (not shown). The fixed ring 69 is secured in place with multiple screws equally spaced about it's circumference. The extension shaft 65 with the coil stop ring 76 welded to it, also has pivot lugs welded to it (not shown). A plurality of pivot links 72 are mounted to pivot lugs on 65 and 69 with pivot pins 73 providing a fixed pivot point along the length of the tubular spindle 71. The outer slide rings 68 also have pivot lugs welded to them (not shown), providing a sliding pivot point along the length of the tubular spindle 71. A plurality of pivot links 72, are mounted to pivot lugs on outer slide rings 68, with pivot pins 73. A plurality of coil leafs 75, including pivot lugs are secured to both sets of links 72, those from the fixed pivot attach from one direction, and those from the sliding pivot attach from the opposite direction, connected with pivot pins 73. A plurality of brake cylinders 62 are mounted in extension arm frame 61 to act upon wheels 66 to provide for speed control of traveling coil support 13. Several different embodiments of a traveling coil support could be employed with the present invention, and traveling coil support 13 is merely illustrative of one such embodiment.

Referring now to uncoiler assembly 30 as shown in FIGS. 3 and 4 including a structural extension arrangement 80, which comprises a plurality of structural beams 44 generally secured to the uncoiler assembly 30 with pivot pin 43 pivotably resting in saddle 187 of uncoiler frame 27 and interconnected to a plurality of pivot links 46 pivotably mounted on pivot pin 56 to uncoiler frame 27. Pivot links 46 are interconnected to structural beams 44 with lifting brackets 39 by multiple cam followers 42, which sandwich the lower flange of structural beams 44 while pivot pin 45 connects lifting brackets 39 to pivot links 46. Pivot links 46 actuated by hydraulic cylinder 47 provide for lifting of structural beams 44 for retracting (see FIG. 4). Hydraulic cylinder 47 is end clevis mounted to uncoiler frame 27 and rod clevis mounted to pivot links 46. Lifting brackets 39 provide mounting for hydraulic motor with chain and sprocket 38 and shaft with sprocket 41. Shaft with sprocket 41 are mounted to lifting bracket 39 with anti-friction bearings. Shaft with sprocket 41 mesh with chain 35 to provide for liner travel of structural beams 44. Chain 35 is mounted directly to structural beams 44 with screws and is secured along full length of structural beams 44. Sliding lift brackets 33 are connected to structural beams 44 with multiple cam followers 37 which sandwich lower flange of structural beams 44. Brackets 33 are equipped with an idler sprocket 34 which is mounted to brackets 33 with anti-friction bearings (not shown). Hydraulic cylinder 29 acts upon sliding lift brackets 33 to adjust height of structural beams 44 for lifting coils or retracting structural beams 44 for travel. Hydraulic cylinder 29 is end clevis mounted to uncoiler frame 27 and rod clevis mounted to sliding lift brackets 33 with pin 57. A plurality of links 31 connect from pivot pin 45 of pivot links 46 to link pin 32 and to pin 57 of sliding lift brackets. These links 31 limit the linear travel of sliding lift brackets 33 to ensure lifting action from cylinder 29. These links 31 further allow the retracting of structural beams 44 by folding down when structural beams 44 are retracted (see FIG. 4). On the extended end of structural beams 44 a pair of hydraulic cylinders 83 are end clevis mounted to a pair of vertical mounts 82 which are pivotably mounted on pins 85 to brackets 84 which are welded to structural beams 44. A guiding bracket 87 is slidably mounted to extendible rod end on hydraulic cylinders 83 and rigidly mounted to vertical mounts 82, A pair of lifting feet 81 are rod clevis mounted to hydraulic cylinders 83. A structural crossmember 86 is mounted between structural beams 44 for rigidity. Lifting feet 81 rest on surface of coil 12 delivery vehicle (not shown). Hydraulic cylinders 83 provide lifting force to raise structural beams 44 to allow gravitational travel of coil 12, secured by traveling coil support 13, thus providing effective transfer of coil 12 from delivery vehicles (not shown), to uncoiler assembly 30.

The uncoiler assembly 30 shown in FIG. 3 further includes hydraulic cylinders 51, end clevis mounted to uncoiler frame 27 and rod clevis mounted to ejector arms 52. Ejector arms 52 are pivotably mounted to pivot pin 49, hydraulic cylinders 51 act upon ejector arms 52 to lift on and cause traveling coil support 13 to roll off uncoiler assembly 30, and onto structural extension arrangement 80, so that it may be used to transfer a new coil 12. A coil stop frame 14 is pivotably mounted to the uncoiler frame 27 with a pair of pivot pins 16 and is adjustable by adjust screw 16. Coil stop frame 14 is there to prevent coil 12 from over traveling in case of operator error or brake malfunction. The top portion of uncoiler frame 27 has a recessed area (or saddle) conforming to the radial shape of wheels 66 on traveling coil support 13. This recessed area provides for securing of the traveling coil support 13, when a coil 12 is loaded onto the uncoiler assembly 30. The uncoiler frame 27 is rigidly mounted to the uncoiler base plate 18, which is pivotably mounted over pivot pin 23 to the substantially flat surface of the uncoiler platform 21. Uncoiler platform 21 is mounted directly to the tractor-trailer rig 70. A gib and spacer 17 secure the outer circumference of the uncoiler base plate 18 allowing it to slide rotationally while holding down on it's periphery. Gib and spacer 17 are mounted to the uncoiler platform 21. A sliding member 54 is mounted to the underside of the uncoiler base plate 21, to nearly match the inside height of the gib and spacer 17. An anti-friction thrust bearing 22 is mounted between uncoiler base plate 18 and uncoiler platform 21. A large sprocket 55 is mounted to the top of pivot pin 23. A hydraulic motor with sprocket and chain 26 are mounted to the uncoiler base plate 18, and connected to large sprocket 55, thus providing rotational energy to allow for rotational travel of uncoiler assembly 30, relative to the uncoiler platform 21. This allows for rotational travel to match with position of coil 12 delivery vehicles (not shown). A pair of pneumatic air bag type actuators with a plate mounted on top 24 is mounted to the top surface of the uncoiler base plate 18. A pair of elongated rollers 25 are mounted with pillow block bearings to the plate on top of 24. These elongated rollers 25 are driven by a hydraulic motor 53 with chains and sprockets, multiple scissor links 37, provide guiding for pneumatic air bag type actuators with plate mounted on top 24, when acted upon, this brings elongated rollers 25 in contact with coil 12. Hydraulic motor 53 can then rotate coil 12 forward or back. A peeling bar 48 is mounted to the uncoiler frame 27 in such a position as to peel sheet 11 from coil 12, as coil 12 is rolled forward.

Figure 5:
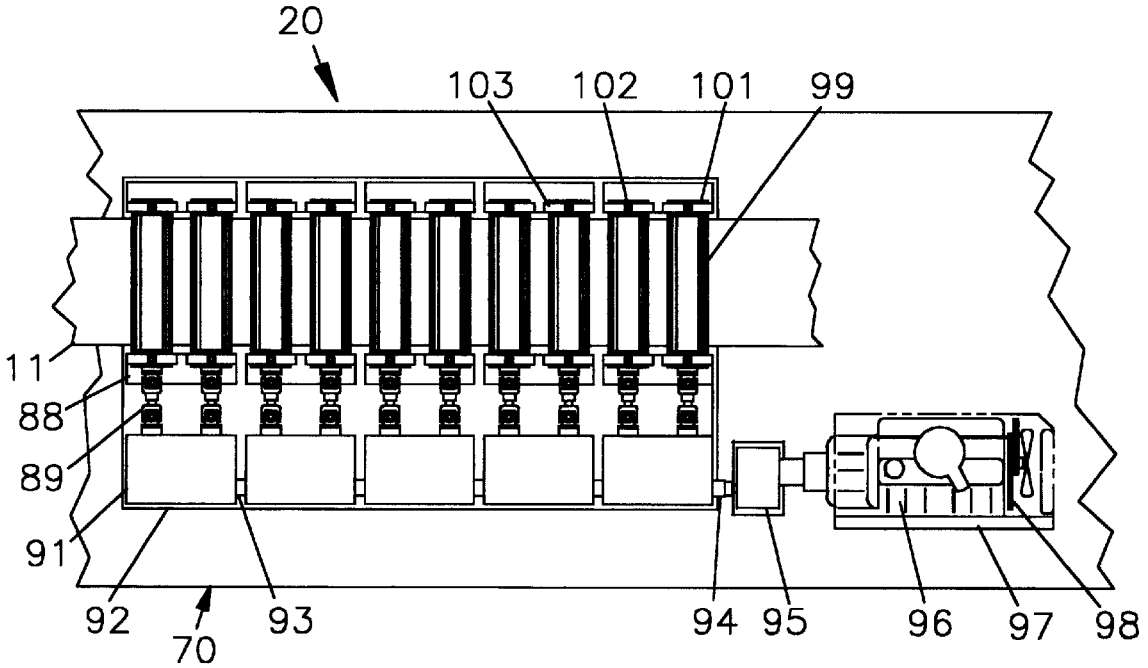
FIG. 5 is a plan view of the assembly of cylindrical rollers with internal combustion engine.
Figure 6:
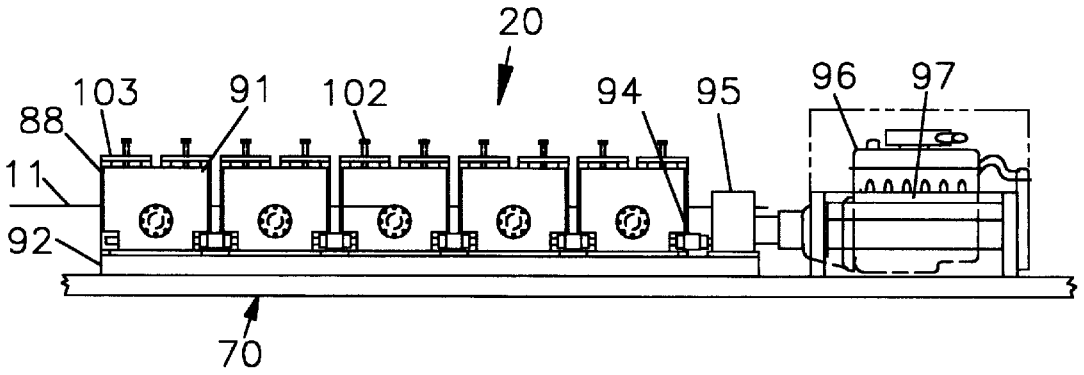
FIG. 6 is a side view of the assembly of cylindrical rollers with internal combustion engine.

Referring now to FIGS. 5 and 6, an assembly of cylindrical rollers 20 comprising a plurality of elongated cylindrical rollers 99 (profiled or smooth depending on type of pipe) are positioned both above and below sheet 11, to provide for rolling, pinching contact. Cylindrical rollers 99 are mounted with anti-friction bearings inside vertically slidable bearing blocks 101. Bearing blocks 101 are secured in a plurality of roll stand frames 88, with the lower cylindrical rollers 99 fixed in height, while the upper cylindrical rollers 99 are adjustable in height to match material thickness of sheet 11. Adjustment is accomplished with vertical adjust screws 102, threadedly mounted through cap bars 103, and to the top of bearing blocks 101 supporting the upper cylindrical rollers 99. Roll stand frames 88 are mounted to a minimal height base frame 92. Cylindrical rollers 99 are rotationally coupled to gearbox 91 with rotational coupling devise 89. Multiple gearboxes 91, when required are rotationally coupled with rotational coupling devise 93. Gearbox(s) 91 are mounted to the minimal height base frame 92 and base frame 92 is mounted to the surface of the tractor trailer arrangement 70. An internal combustion engine and transmission 96, is mounted with a frame and cover 97, to the surface of the tractor trailer arrangement 70, as a part of cylindrical roller assembly 20 and is rotationally coupled through rotational coupling devise 94 and 95. Internal combustion engine and transmission 96 provides rotational energy and for controllably coupling rotational energy to the cylindrical roller assembly 20. Internal combustion engine and transmission 96 provides rotational energy for support apparatus, transmitted with belts and pulleys 98, support apparatus includes, hydraulic pump (not shown), air compressor (not shown) and generator (not shown).

Figure 7:
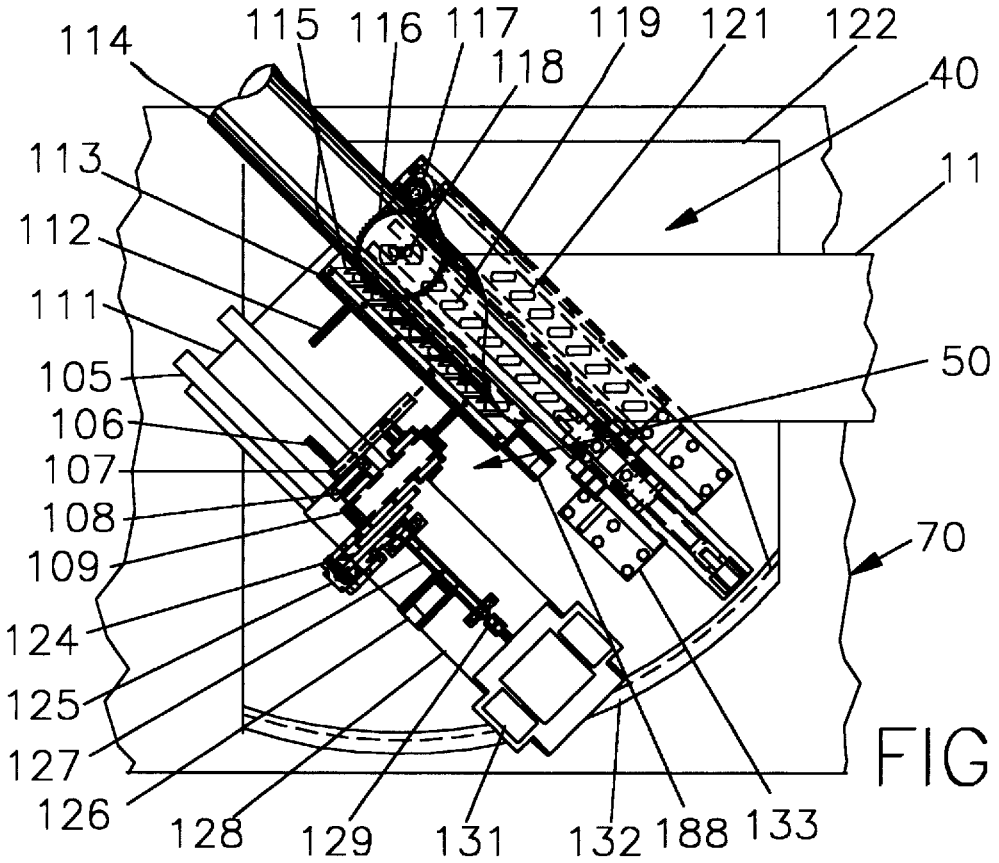
FIG. 7 is a plan view of the spiral forming assembly.
Figure 8:
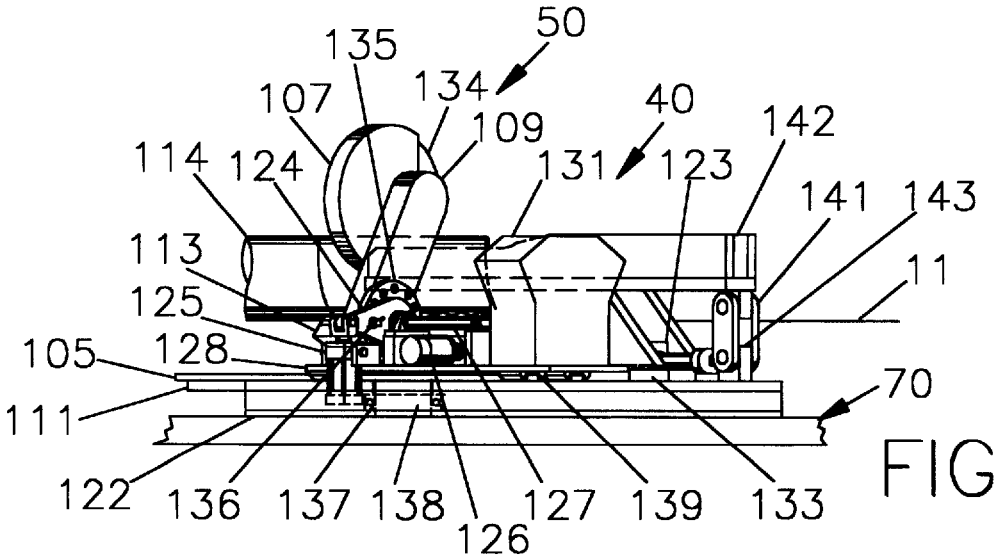
FIG. 8 is a side view of the spiral forming assembly.

Referring now to FIGS. 7 and 8 spiral forming assembly 40 comprising, three sets of rollers 121, 119 and 115. The first set of rollers 121 (commonly referred to as the lead roll assembly), includes multiple yoke mounted rollers secured to a base plate which is mounted to the three roll table 111, the second set of rollers 119 (commonly referred to as the mandrel roll assembly) includes multiple yoke mounted rollers secured to the underside of the mandrel 142, the third set of rollers 115 (commonly referred to as the buttress roll assembly) includes multiple yoke mounted rollers secured to a base plate that is mounted to a wedged shaped support 113 that is slidably mounted to the three roll table 111. The incoming sheet 11 rolls over the top of the first set of rollers 121 and then under the second set of rollers 119 and then is pushed up by third set of rollers 115. This puts a radius into the sheet 11 which is the result of the third set of rollers 115 position, in toward the second set of rolls 119 for smaller diameters, or out farther away from the second set of rolls larger diameters, all three sets of rollers 121, 119 and 115 are mounted pivotably to align perpendicularly to the incoming sheet 11, while the three roll table 111 which is pivotably mounted to the substantially flat surface of the three roll platform 122 is rotationally positioned at a predetermined helix angle relative to the incoming sheet 11 for a given diameter, this allows the edges to meet as sheet 11 curves up and over to form pipe 114. A pair of rollers located generally at 118 above and below the incoming sheet 11 are used to assist in the seaming of edges as they meet, for welded seam pipe these rolls straddle the edges one under sheet 11 and the other over the sheet 11 as it is just becoming pipe 114 with a welding head (not shown) located atop the seam between. For lockseam pipe these rollers 118 act as seam closing rolls for the incoming edges of sheet 11 where the edges have been rollformed with engagement lips (not shown). In both cases whether welding or lockseaming these rollers located generally at 118 are used to affect diameter as well as assist in seaming, by raising or lowering the rollers, small alterations in diameter can be made. The three roll table 111 is pivotably mounted to the three roll platform 122 with pivot pin 138. It is important that the pivot pin 138 be directly under seaming line edge of sheet 11 as shown in FIG. 7, an anti-friction thrust bearing 137, is mounted between the three roll table 111 and three roll platform 122. A large sprocket 116 is mounted to the top of pivot pin 138. A servo motor with sprocket and chain 117 are mounted to the three roll table 111 and connected to large sprocket 116, thus providing rotational energy to allow for rotational travel of spiral forming assembly 40, relative to the three roll platform 122. A gib and spacer 132 secure the outer circumference of the three roll table 111 allowing it to slide rotationally while holding down on it's periphery. A gib and spacer 132 are mounted to the three roll platform 122, a sliding member (not shown) is mounted to the underside of the three roll table 111 to nearly match the inside height of the gib and spacer 132. Mandrel 142 is pivotably mounted to the three roll table 111 with mandrel stands 133. The mandrel 142 may be pivoted up out of the way for servicing when needed by actuating hydraulic cylinder 123 which is end clevis mounted the three roll table 111, and rod clevis mounted to the link slide bracket 143. The link slide bracket 143 is slidably mounted to the three roll table, as links 141 are pulled back by hydraulic cylinder 123, links 141 pull down on mandrel 142. A laser level (not shown) is mounted to the side of mandrel 142 to provide a line of sight level for the pipe support stands 60 (not shown). The slidably mounted wedged shaped support 113, is adjustable in and out in relationship to the second set of rollers 119, along a pair of gear racks 112. A servo motor 188 connects to pinion gears (not shown) to provide the rotational energy to affect the linear position. Both servo motor 188 and servo motor with chain and sprocket 117 is interconnected for electric controllability to a programmable control unit in the control console 191.

The cut off assembly 50 shown most clearly in FIGS. 7 and 8 comprises a pair of linear rails 105 mounted to the three roll table 111. A slide plate 128 mounted with linear travel slide blocks 139. An internal combustion engine 131 is mounted to the slide plate 128 to provide rotational energy to a saw blade 134, a rotary coupling device 129 connects engine 131 to shaft 127 which is supported between pillow blocks 124 and 108 and drives a rotary coupling arrangement 109, which transfers rotational energy to the saw blade 134. Adjust ring 135 directly mounts to the rotary coupling arrangement 109 to allow for angular positioning of saw blade 134 relative to the size of pipe produced. Actuator bracket 124 is connected to adjust ring 135 with connecting pin 136. Hydraulic cylinder 125 is trunion mounted with bars to slide plate 128 and rod clevis mounted to actuator bracket 124. The saw blade guard 107 is provided as a safety device. A servo motor 126 is mounted to slide plate 128 and provides rotational energy to a pinion gear (not shown), that translates the rotational energy into linear travel along rack 106. Servo motor is interconnected for electric controllability to a programmable control unit in the control console 191.

Figure 9:
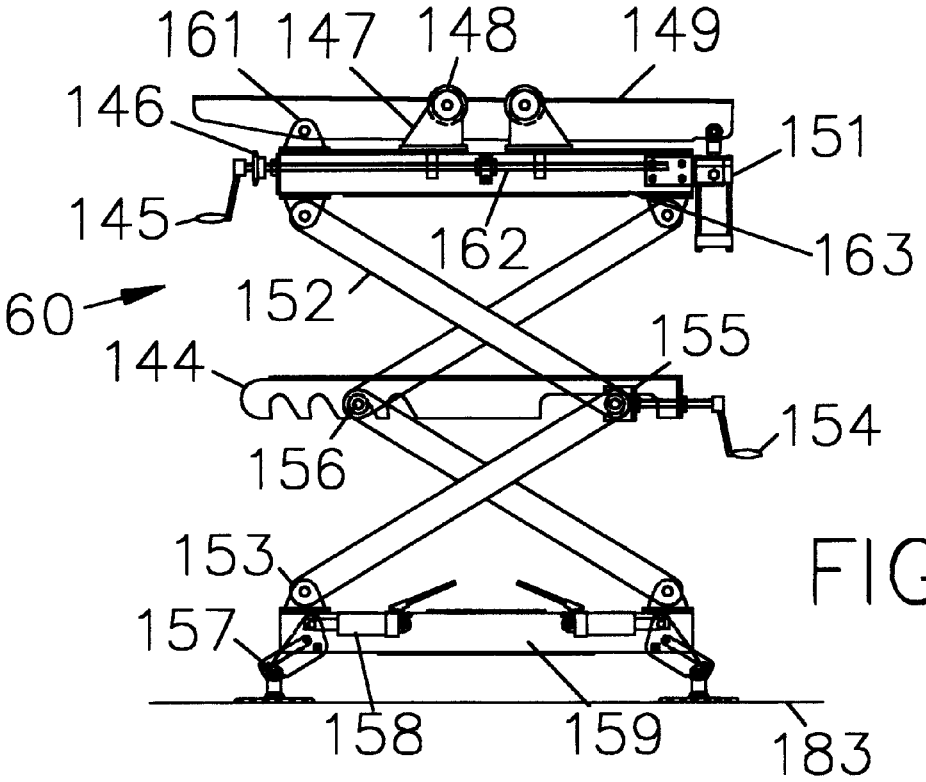
FIG. 9 is a frontal view of a pipe support stand.

Referring now to FIG. 9 pipe support stands 60, comprising a base frame 159, with feet 157 mounted to hand pump leveling jacks 158, in four corners contacting the ground 183. Scissor links 152 mount to pivot brackets 153 and provide for vertical height adjustment, as well as reducing height for storage upon tractor trailer arrangement 70 (not shown). Crossmember shafts 156 are mounted at central pivot locations between base 159 and table 163. An adjust frame 144 straddles the two crossmember shafts 156 and assists in vertical adjustment with adjust block 155 connected to adjust screw 154. Adjust frame 144 has several engagement slots for a wide range of height adjustment. Table 163 has a plurality of elongated rollers 148 mounted to adjust brackets 147 and connected to threaded shaft 162 with both right and left handed threads to allow for simultaneous adjustment in and out of adjust brackets 147. Sprocket 146 connects to other screw 162 to allow for parallel adjustment of brackets 147 with handle 145. Kick off arm 149 is pivotably mounted to the top of table 163 with pivot mount 161 and is actuated by cylinder 151 which is trunion mounted to table 163 and rod clevis mounted to kick off arm 149. This allows for pipe 114 (not shown) removal. As many stands as required to support pipe lengths, may be used. Each support stand is fitted with a wire frame target (not shown) for line of sight leveling in relationship to the laser level mounted to the spiral forming assembly 40 (not shown).

Figure 10:
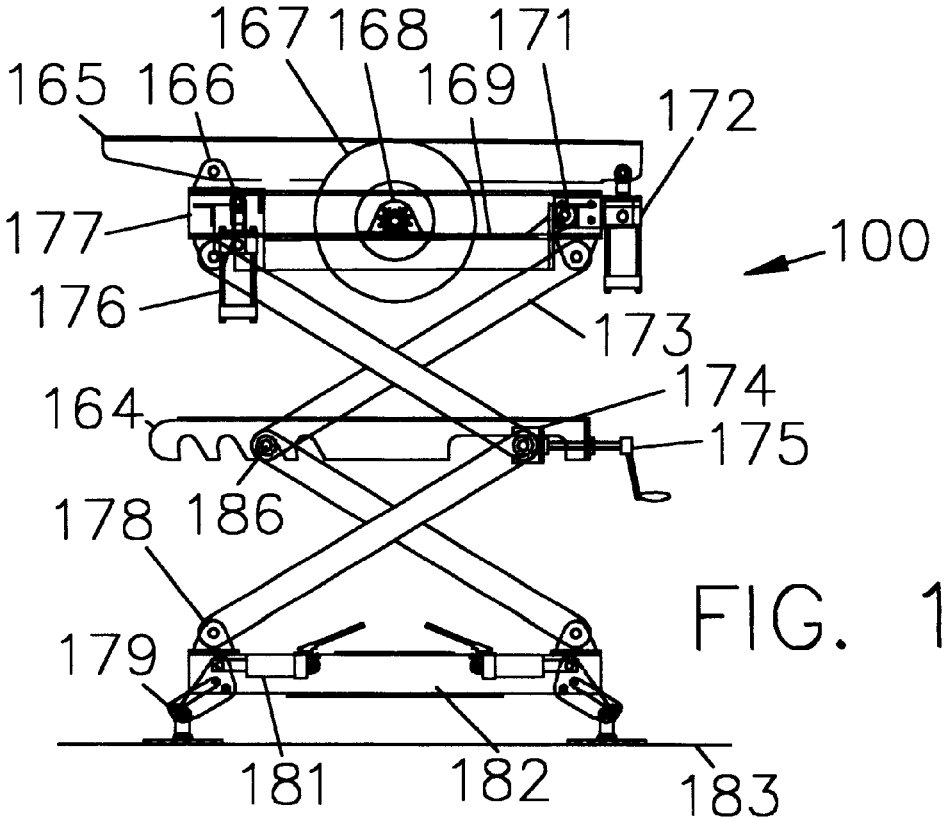
FIG. 10 is a frontal view of pipe support stand with driving wheels.

Referring now to FIG. 10, pipe support stand with accelerator rolls 100, comprising a base frame 182 with feet 179, mounted to hand pump leveling jacks 181, in four corners contacting the ground 183. Scissor links 173 mount to pivot brackets 178 and provide for vertical height adjustment, as well as reducing height for storage upon tractor trailer arrangement 70 (not shown). Crossmember shafts 186 are mounted at central pivot locations between base 182 and table 177. An adjust frame 164 straddles the two crossmember shafts 186 and assists in vertical adjustment with adjust block 174 connected to adjust screw 175. Adjust frame 164 has several engagement slots for a wide range of height adjustment. Table 177 has a drop frame 169 mounted to pivot mounts 171, and actuated by cylinder 176 which is trunion mounted to table 177 and rod clevis mounted to drop frame 169. A pair of tires 167 are mounted with pillow blocks 168 to drop frame 169. The tires 167 are driven by direct connected hydraulic motor (not shown). Tires 167 are raised and lowered by hydraulic cylinder 176 to contact lower circumference of pipe (not shown). Tires are positioned a with pipe helix angle to spin pipe out beyond the machine after cutoff. Kick off arm 169 is pivotably mounted to the top of table 177 with pivot mount 166, and is actuated by cylinder 172 which is trunion mounted to table 177 and rod clevis mounted to kick off arm 165. This allows for pipe 114 (not shown) removal from pipe support stand 100. This support stand is fitted with a wire frame target (not shown) for line of sight leveling in relationship to the laser level mounted to the spiral forming assembly 40 (not shown).

Various changes and modification may be made in carrying out the present invention without departing from the spirit and scope thereof. Insofar as these changes and modifications are within the purview of the appended claims, they are to be considered as part of the invention.

I claim:

1. A vehicle transportable apparatus for spirally forming pipes from steel sheet in coil form comprising means for supporting said coil in an uncoiler assembly and allowing for uncoiling means for feeding and rotationally driving said sheet from said coil into means for curving up said sheet while joining its edges for forming said pipes and onto means for supporting and unloading said pipes that have been formed whereby said apparatus will be readily transportable to various locations.

2. The combination of claim 1 further including means for transferring said coil to said uncoiler assembly comprising a structural extension arrangement that extends horizontally from said uncoiler assembly to allow for travel of said coil.

3. The combination of claim 1 wherein said uncoiler assembly includes means for rotational travel comprising a motor for providing rotational energy coupled to said uncoiler assembly with rotational pivot connection to a substantially flat surface that provides for rotational slidability.

4. The combination of claim 1 wherein said means for feeding and driving said sheet includes an assembly of cylindrical rollers mounted to a base frame of minimal height.

5. The combination of claim 1 wherein said means for curving up said sheet while joining its edges for forming said pipes includes a spiral forming assembly mounted to a base frame of minimal height.

6. The combination of claim 1 further including a cut off assembly for cutting said spirally formed pipes to predetermined lengths comprising, means for cutting said pipes mounted to a horizontal traveling plate arrangement that is slidably attached to said means for curving up said sheet while joining its edges for forming said pipes.

7. The combination of claim 1 wherein said means for supporting and unloading said pipes includes a plurality of rollers mounted with bearings connected to a frame structure providing means for vertical adjustment and leveling of said means for supporting and unloading said pipes.

8. The combination of claim 4 wherein said assembly of cylindrical rollers includes an internal combustion engine for producing rotational energy and means for controllably coupling rotational energy from said engine to said assembly of cylindrical rollers.

9. The combination of claim 5 wherein said spiral forming assembly includes pivotable mounting to a substantially flat surface with a motor for controllably adjusting said spiral forming assembly whereby said pivotable mounting allows for positioning of said spiral forming assembly in relationship to said means for feeding and driving said sheet.

10. The combination of claim 5 wherein said spiral forming assembly further comprises three sets of rollers, one set of said rollers, includes, a slidably mounted wedge shaped support with a means of rotational energy to affect linear position, connected with means of programmable control, whereby said means of programmable control enables more efficient set up.

11. The combination of claim 9 wherein said spiral forming assembly includes said pivotable mounting with said motor for controllably adjusting said spiral forming assembly connected to a means of programmable control whereby said means of programmable control enables more efficient set up at various locations.

12. The combination of claim 7 wherein said means of vertical adjustment and leveling also provides for compactability whereby said means for supporting and unloading said pipes is readily transportable.

13. A vehicle transportable method of spirally forming pipes from steel sheet in coil form comprising the steps of transporting said method to a location where said pipes will be used, transferring said coil, unrolling said coil into said sheet, feeding said sheet, forming said sheet into said pipes and supporting said pipes.

14. The method of claim 13 further including the step of rotating an uncoiler assembly while preparing for said transferring of said coil, whereby said transferring can be performed from various positions.

15. The method of claim 13 wherein said transferring of said coil includes the step of lifting on a plurality of beams whereby said lifting allows for gravitational travel of said coils.

16. The method of claim 13 further including the step of adjusting said forming, whereby said step of adjusting said forming, is performed to produce diameters of nearly unlimited range.

17. The method of claim 13 wherein said supporting said pipes, includes the step of moving supports to accommodate pipe lengths, whereby longer lengths of pipe may be produced.

* * * * *